US005760540A

United States Patent [19]

Duistermaat

[11] Patent Number: 5,760,540

[45] Date of Patent: Jun. 2, 1998

[54] CRT DISPLAY DEVICE FOR USE IN HIGH AMBIENT LIGHT

[75] Inventor: Jan H. Duistermaat, Someren, Netherlands

[73] Assignee: U.S. Philips Corporation, New York, N.Y.

[21] Appl. No.: 527,238

[22] Filed: Sep. 12, 1995

[30] Foreign Application Priority Data

Oct. 11, 1994 [EP] European Pat. Off. ..... 94202935

[51] Int. Cl.[6] ..... H01T 29/06

[52] U.S. Cl. ..... 313/477 R; 313/478; 313/479

[58] Field of Search ..... 313/478, 479, 313/477 R, 112, 113

[56] References Cited

U.S. PATENT DOCUMENTS 5,150,004 9/1992 Tong et al. ..... 313/479
5,243,255 9/1993 Iwasaki ..... 313/478
5,396,148 3/1995 Endo et al. ..... 313/478

OTHER PUBLICATIONS

SID 86 Digest, vol., 1986, (New York, USA), J.R. Stevenson et al, Optical characterization of Anti-Glare Surfaces on Cathode Ray Tubes, pp. 424–427, col. 1, line 3–line 9.

*Primary Examiner*—Nimeshkumar Patel
*Attorney, Agent, or Firm*—John C. Fox

[57] ABSTRACT

A CRT display device including an envelope having a faceplate of a predetermined light transmissivity, a luminescent screen disposed on an inner surface of the faceplate and electron beam producing means disposed within the envelope for exiting the screen to effect production of a luminescent image, a neutral density transmissivity filter means disposed adjacent an outer surface of the faceplate, wherein for viewing under high ambient light conditions the total transmissivity $T_t$ is $10\% \leqq T_t \leqq 30\%$, and during operation of the display device the electron beam producing means produce a beam current density on the screen such that the contrast $C_{4000}$ is $4 \leqq C_{4000} \leqq 8$.

21 Claims, 2 Drawing Sheets

CRT DISPLAY DEVICE FOR USE IN HIGH AMBIENT LIGHT

BACKGROUND OF THE INVENTION

The invention relates to CRT display devices and in particular to a CRT display device including an envelope having a faceplate, a luminescent screen disposed within the envelope and a means for generating an electron beam for exciting the screen to effect production of a luminescent image.

A common problem with CRT display devices, such as computer monitors and televisions, is disturbing reflections of ambient light from the luminescent screen of the CRT component utilized in each device. Such reflections reduce the contrast of the luminescent image produced by the CRT.

A second problem is that of the ambient light rays passing through the glass of the tube and striking the phosphors. In addition to being diffuse emitters of light, the phosphors also act as diffuse reflectors. Consequently, the ambient light rays are reflected diffusely off all the phosphors, whether or not they are being activated by the electron beam of the tube at the time. Since the ambient light, particularly on a bright day, may be far greater than the light of the activated phosphors, the reflected ambient light may and frequently does completely "wash out" or obliterate the signal. This results from the fact that the shadows, background, or low lights, are illuminated by the ambient light to such an extent that they cannot be distinguished from the signals, or high lights. The image is confused and in some cases completely lost.

Numerous methods and devices have been proposed to enhance the contrast of display devices in environments having bright ambient light.

In order to attenuate these reflections CRT faceplates are commonly made of tinted glass and/or have a neutral density transmissivity filter disposed on an outer surface. Because the luminescent screen of a CRT is disposed on the inner surface of the faceplate, the ambient light must pass through the thickness of the faceplate twice. The reflected ambient light is thus attenuated to a much greater extent than the light from the luminescent image produced on the screen, which passes through the faceplate only once.

Although this approach improves the visibility of the luminescent image, it has significant limitations. As the brightness of the ambient light radiation increases, so does that of its reflection. In order to maintain contrast, it is conventional to increase the brightness of the light from the luminescent image to have it predominate over the reflected light. In brightly lighted surroundings, the combined brightness levels of the luminescent image light and the reflected ambient light can be so high as to cause discomfort to the viewer despite the eye's adaptation capabilities.

For a shadow mask colour CRT display device there is also a thermal limitation of the shadow mask. Increasing the brightness of the light from the luminescent image would involve higher beam currents, giving rise to expansion of the shadow mask and inevitably adversely influencing of the colour purity. Moreover, higher beam currents are at the expense of the resolution on the screen.

OBJECTS AND SUMMARY OF THE INVENTION

It is an object of the invention to provide an improved CRT display device which enables viewing in high levels of the ambient light.

In accordance with the invention, the display device is characterized in that the diffuse reflection coefficient of the faceplate is less than 2.5% ($R_d \leqq 0.025$).

Hitherbefore known CRT display device have diffuse reflection coefficients higher than approximately 5%, typically in the range 5–10%.

The above condition for the diffuse reflection coefficient is for CRT display devices irreconcilable with hitherbefore generally held views on the required luminance capacity for a CRT display device. The above condition is, however, based on the insight that the luminance capability is not as important as generally regarded today. Instead, one should concentrate fully on the display tubes (colour monitor tube (CMT) or television tube (TVT)) contrast performance capability, preserving excellent black levels even in conditions of (very high) ambient illuminance: e.g. $C_{4000}$, in the 4000 lux ambient illuminance condition.

In other words: contrast makes the picture clear.

Using a CRT display device according to the invention it becomes possible to drive such a Hi-Ambient CMT as normal i.e. not above a beam current density of 1 $\mu A/cm^2$, and preferable not above 0.85 $\mu A/cm^2$, and achieve a $C_{4000}$ contrast performance of for instance $4 \leqq C_{4000} \leqq 8$.

The diffuse reflection coefficient is determined by a number of factors, such as the transmissivity of the faceplate ($T_g$), and the transmissivity of coatings on the faceplate, if present ($T_{coat}$), and the reflection coefficient of the luminescent screen and of a black matrix (if present). In formula the following holds $$R_d = T^2_f * T^2_{coat} * F$$

where F is dependent on the diffuse reflection of the phosphors and the presence of a black matrix and ranges between approximately 0.65 for a non-matrix luminescent screen and approximately 0.3 for a black matrix luminescent screen. The transmissivity T is here the average transmissivity over the visible range. The factor F is grosso modo determined by the diffuse reflection of the luminescent screen. For most phosphors said diffuse reflection is approximately 65% (i.e F=0.65). Therefore for a tube without a black matrix F is approximately 0.65. For tubes having a black matrix of the factor is reduced since the diffuse reflection of a the black matrix material is only 5%. Therefore if the coverage of the black matrix is x% the factor F is approximately 0.05*x+0.65*(1−x). The coverage x for a line-type phosphor screen (often used for TVT) is usually less than for a dot-type phosphor screen (often used for CMT). A typical value for F for a line-type phosphor screen with a black matrix is approximately 0.43, for a dot-type phosphors screen approximately 0.30.

In the condition that there is no coating on the faceplate the factor $T_{coat}$ is 1. Transmission coefficient and reflection coefficient are to be understood to mean coefficient for visible light. Should the faceplate be provided with more than one coating, the transmission coeffient $T_{coat}$ is the product of the transmissivity coefficients of the respective coatings (i.e. $T_{coat} = T_{coat1} * T_{coat2}$ etc).

The total transmissivity coefficient of a faceplate is the product of the transmission of the faceplate and, if present, transmission reducing coating(s) on the faceplate ($T_f = T_g \cdot T_{coat}$). Preferably the total faceplate transmissivity $T_f$ lies between 10–25%. By tuning the total faceplate transmissivity $T_f$, e.g. $10\% < T_f < 25\%$; the white field luminances $B_{max,4000}$ then range from 35 cd/m²—still conform the ISO 9241-3 min. luminance level—with $T_f \approx 10\%$, up to a more "normal" 100 cd/m² with $T_f \approx 25\%$. The above indicated preferred range for $T_t$ differs somewhat for different types of display devices. Prefered ranges are for a CMT with a black matrix $12.5\% < T_t < 29\%$, for a TVT with a black matrix $10\% < T_t < 25\%$ and for a CMT or TVT or a monochrome tube without a black matrix $5\% < T_t < 12\%$. These ranges roughly correspond to values of $R_d$ between 0.5 and 2.5%. The difference in these ranges reflects the use (or not) of a black matrix and the different coverages of such black matrix.

Preferably the diffuse reflection coefficient is more than 0.5%. Smaller values for $R_d$ means greater ratios between the diffuse reflection coefficients of the faceplate and of surrounding surfaces which leads to a discomforting effect.

Within the concept of the invention the CRT display device is preferably provided with a transmission reducing coating. As explained above the total transmissivity is a product of the transmissivity of the faceplate and of the transmission of coating(s). The thickness of the faceplate is a.o. determined by safety considerations and shows a variation over the faceplate. As a consequence the transmission of the faceplate shows a variation over the faceplate. Such variation is the more prominent the lower the transmissivity coefficient of the faceplate. Typically the thickness of the faceplate varies 10–15% over the faceplate. This leads for instance for a faceplate transmissivity of 20% in the centre of the faceplate to a variation of the transmission of approximately 20–30% (i.e. the transmissivity varies between 14 to 16% at the edges of the faceplate to 20% in the centre of the faceplate). The variation of $R_d$ ($R_d$ scales with $T_t^2$) is then approximately 40–60%. The thickness of the transmission reducing coating is, however, not dependent on safety considerations. By applying a transmission reducing coating the variation of $R_d$ over the faceplate is therefore less. Preferably the transmissivity of the faceplate ($T_t$) is higher than 40%. Within the framework of these embodiments of the invention means which perform the same function as transmission reducing coatings applied directly on the faceplate, such as for instance neutral density filter and/or transmission reducing plates positioned in front of the faceplate, are to be understood to be equivalent to a "coating provided on the faceplate". Preferably, however, the transmission reducing coating is applied on a surface of the faceplate. Compared to the use of for instance a transmission reducing plate positioned in front of the faceplate, the number of elements is reduced. Preferably the applied transmission reducing coating shows an increase of the transmissivity (i.e. an increase of $T_{coat}$) from the centers to the sides. The decrease in total transmissivity ($T_t$) due to the thickness increase of the faceplate from the center of the faceplate to the sides is thereby at least partly counteracted.

Preferably the CRT display device is provided with means to reduce the specular reflection of the faceplate, preferably on the inner as well as on the outer side of the faceplate. Preferably the specular reflection on the outer side is less than 0.5%. An advantageous embodiment comprises a multilayer coating on the outside which functions as a transmission reducing coating as well as as a specular reflection reducing coating.

BRIEF DESCRIPTION OF THE DRAWING

Other objects and features of the invention will be more fully understood from the detailed description and claims when taken with the accompanying drawings.

DESCRIPTION OF THE PREFERRED EMBODIMENTS

Figure 1:
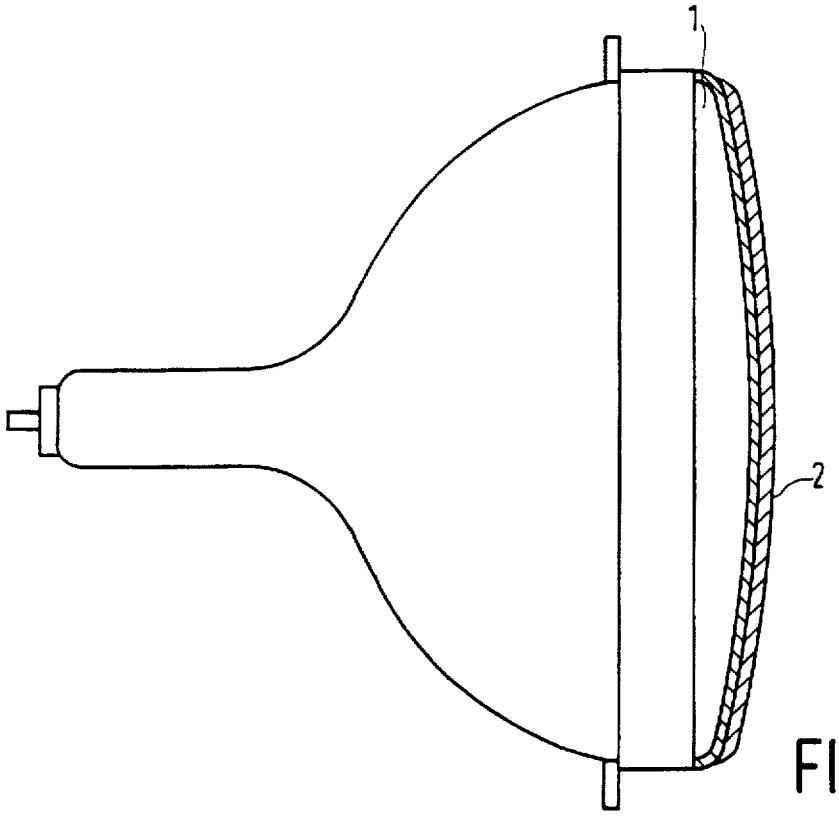
FIG. 1 is a side view, partially in section, of cathode ray tube according to a first preferred embodiment of the present invention.

FIG. 1 is a side view, partially in section, of a cathode ray tube (CRT) according to a first preferred embodiment of the present invention. The CRT illustrated is of a high-definition type to be applied to a terminal display for a computer, for example. While a known electron gun or the like (not shown) is provided in the CRT, the detailed explanation thereof will be omitted because it is not directly related to the scope of the present invention.

Referring to FIG. 1, reference numeral 1 denotes a front panel of the CRT, and reference numeral 2 denotes a film or coating formed on the front panel 1 by a method to be hereinafter described. The film 2 serves to reduce ambient light reflections, to which end it absorbs visible light. The visible light absorbing transmission reducing layer 2 preferably contains a black dye to prevent that the front panel 1 looks whitish at a bright place. In particular example the layer 2 comprises a silicon dioxide, a black dye and an optionally oxide of a metal selected from the group formed by Ge, Zr, Al and Ti.

If desired, it is alternatively possible to provide the filtering layer on a separate transparent front plate instead of on the display screen itself.

Under circumstances it may be advantageous to not use a conventional display screen with a transmissivity of 52%, but a screen having a lower transmissivity,. e.g. the 42% transmissivity screen used in certain 17" CMT's.

The invention is based on the insight that currently available CMT's cannot maintain a minimum contrast required for easy reading etc. in high ambient illuminance conditions ($E_h$>1000 lux). It is currently believed that display luminance levels of 100 cd/m$^2$ or more are needed in conditions of high ambient luminance.

As an example, for a contrast $C=(B_{max}+B_{min})/B_{min}=6$, at ambient luminance=1000 lux condition, the following holds:

A conventional CMT with $T_t$=52%, without a transmission reducing coating ($T_{coat}$=1) and a $T_{mat}$=14% (transmission coefficient of the black matrix phosphor screen structure), will have a diffuse reflectivity factor $R_d$≈8.7%, yielding a black level luminance in the ambient illuminance=1000 lux condition:

$$B_{min}=\text{ambient luminance}*\text{diffuse reflectivity factor}/\pi=E_h*R_d/\pi=1000\times0.087/\pi\approx26\ \text{cd/m}^2$$

To achieve the requested value of C of 6, $B_{max}$ should therefore be 130 cd/m$^2$, whihc is in accordacne with generaklly held views that at such high illumination a display luminance of 100 cd/m$^2$ or more is needed. For conventional CMT's such a $B_{max}$ is indeed attainable. Screen loads of 0.85 μA/cm$^2$ give values for $B_{max}$ of approximately such values. Contrast will be C=(130+26)/26=6. Generally held views require the luminance capacity for a CRT display device to be high ($B_{max}$>100 cd/M$_2$) in order for there to be a good picture. Intuitively it would seem that for even higher ambient luminances (>1000 lux) the value for $B_{max}$ should at least be held constant, if not increased. The more light falls on the display device, the brighter it should be seems at least prima facie a reasonable assumption. The international standard ISO9241-3 for instance specifies 35 cd/m$^2$ as the minimum for the lower luminance but that in conditions of high ambient luminance higher values (e.g. 100 cd/m$^2$) are preferred.

Lowering the diffuse reflection capability $R_d$ leads to lowering the luminance value. A CRT display device according to the invention has a diffuse reflection coefficient of less than 2.5%. Such a small diffuse reflection coefficient reduces display luminance to values far below 100 cd/m$^2$. For example the above described value of $B_{max}$ of 130 cd/m$^2$ would be reduced to a value of 36 cd/m$^2$ if nothing else is changed, far below the minimum value of 100 cd/m$^2$ as required by the prevailing views. To achieve nevertheless the "required" luminance capability of>100 cd/m$^2$ the screen load would have to be increased to a value in the order of 2.5 μA/cm$_2$. Such high screen loads, however, are so demanding on the cathodes (lifetime) and on the shadow mask (doming problems) that for present designs very serious problems arise. It gives rise to detrimental expansion of the shadow mask and inevitably adversely influencing of the colour purity. Moreover, higher beam currents are at the expense of the resolution on the screen. And thirdly at such high current levels even in zero ambient luminance due to backscatter mechanisms the contrast is diminished.

However, should the prevailing requirement be contrast rather than luminance, the way to be taken, as is recognized within the framework of the invention, is to reduce the black level luminance viz. the screen's diffuse reflectivity, e.g. by lowering the screen glass' total transmission. The luminance capability is not as important as generally regarded but, instead, one should concentrate fully on the contrast performance capability, preserving excellent black levels even in conditions of very high ambient illuminance.

Again, as an example, for the above contrast C=6 and $B_{max}$=35 cd/m$^2$, we have seen $B_{min}$ should not exceed 7 cd/m$^2$ in the ambient illuminance $E_h$=1000 lux condition. This can be satisfied with a reduced diffuse reflectivity, down to $$R_d=\pi\times B_{min}/E_h=\pi\times 7/1000\approx 2.2\%$$

for which a total screen glass transmissivity (still assuming $T_{mat}$=14%), $$T_t=\sqrt{(R_d/0.302)}=\sqrt{(0.022/0.302)}\approx 27\% \text{ would do.}$$

The latter value for $T_t$ follows from the formula $R_d=T_t^2*F$ where F is 0.302 for a matrix tube with a black matrix transmissivity of the matrix of 14%, approximately 0.43 for a matrix tube with a black matrix transmissivity of 28% and approximately 0.65 for a tube without a black matrix.

Such a diffuse reflective coeeficient is far below presently used values which range between 5 and 10%.

As the standard CMT's luminance is $B_{max}\geqq 100$ cd/m$^2$with $T_t$=52%, and the available luminance with $T_t$=27% would reduce to $B_{max}\geqq 27\times 100/52$ =52 cd/m$^2$, in the same application we now have $$C=(B_{max}+B_{min})/B_{min}\geqq=52+7/7\approx 8.4x!$$

and, for C=6× the drive applied to the tube might even be reduced, with sharpness improvement as an added bonus. I.e. the items the invention deals with are brightness-contrast performance issues!

For a better understanding of the brightness-contrast performance issues in relation to the human perception, it is important to realize that, as with hearing, the human vision system "measures", to a good approximation, relative strengths, and hence a transformation of luminance to the logarithm of luminance should be involved.

It is proposed to express luminances e.g. $B_{max}$, $B_{min}$ in dB w.r.t. a suitable reference level, e.g. 0 dB≡0.1 cd/m$^2$, and hence $$B(cd/m^2)\equiv 10\log B/0.1(dB)$$

thus, the contrast between two different luminance values $B_1$and $B_2$ is $$C(dB)=B_1(dB)-B_2(dB).$$

The "first important difference" we can hear or see, is believed to be about 2 dB; this serves to illustrate the weakness from the perceptual point of view to argue the importance of e.g. $B_{max}$=120 cd/m$^2$ over $B_{max}$=100 cd/m$^2$, or an impressive 20% difference, which reduces to $B_{max}$= 30.8 dB compared to $B_{max}$=30 dB : a difference of just 0.8 dB which would go unnoticed when not very close to each other (such a difference in one screen area, close to each other, is readily detected!).

On the other hand, black level performance differences that are unimpressive in absolute terms are put in the right perceptual perspective when expressed in dB: from the examples presented hereinbefore:

with $T_t$=52%, in the ambient illuminance condition $E_h$=1000 lux, $B_{min}$=24.15 dB; for C=6×≡7.78 dB, ($B_{max}$+$B_{min}$) should reach 24.15.+7.78=31.93 dB(≡156 cd/m$^2$);

with $T_t$=27% and in $E_h$=1000 lux, $B_{min}$=7 cd/m$^2$≡18.45 dB, a reduction by 24.15–18.45=5.7 dB;

and for C=6×≡7.78 dB, ($B_{max}$+$B_{min}$)=18.45+7.78=26.23 dB(≡42 cd/m$^2$), a reduction by 31.93–26.23=5.7 dB too, of course;

both brightness levels, black, and white, have to be reduced by 5.7 dB, but in absolute terms the black level reduction is by 26–7=19 cd/m$^2$, while the white luminance reduction, for the same contrast, is by 156–42= 114 cd/m$^2$!

There might be an issue of black level deterioration in the operating CMT displaying e.g. a monochrome chessboard pattern, imminent in 0 ambient illuminance conditions, due to an electron backscatter mechanism in the CMT; it limits contrast <<∞. It's contribution, estimated at some 3 cd/m$^2$≡14.7 dB(21", $T_t$=52%, at 27.5 kV/1.1 mA), will be reduced with $T_t$;

e.g. in the above situation with $_t$=27% the backscatter contribution is reduced to 27×3/52=1.56 cd/m$^2$=11.9 dB;

the black level in a relatively high e.g. 1000 lux ambient illuminance increases to $B_{min}$=7+1.56=8.56 cd/m$^2$≡19.3 dB, an increase by a mere 0.85 dB, and neglectable;

in a lowish 250 lux ambient illuminance the black level increase due to backscatter electrons is relatively more important:

$B_{min}$=(250×0.022/π)+1.56=1.75+1.56≈3.3 cd/m$^2$≡15.2 dB, compared to 1.75 cd/m$^2$≡12.4 dB: an increase by 2.8 dB.

The backscatter phenomenon will be included in the considerations.

Figure 2:
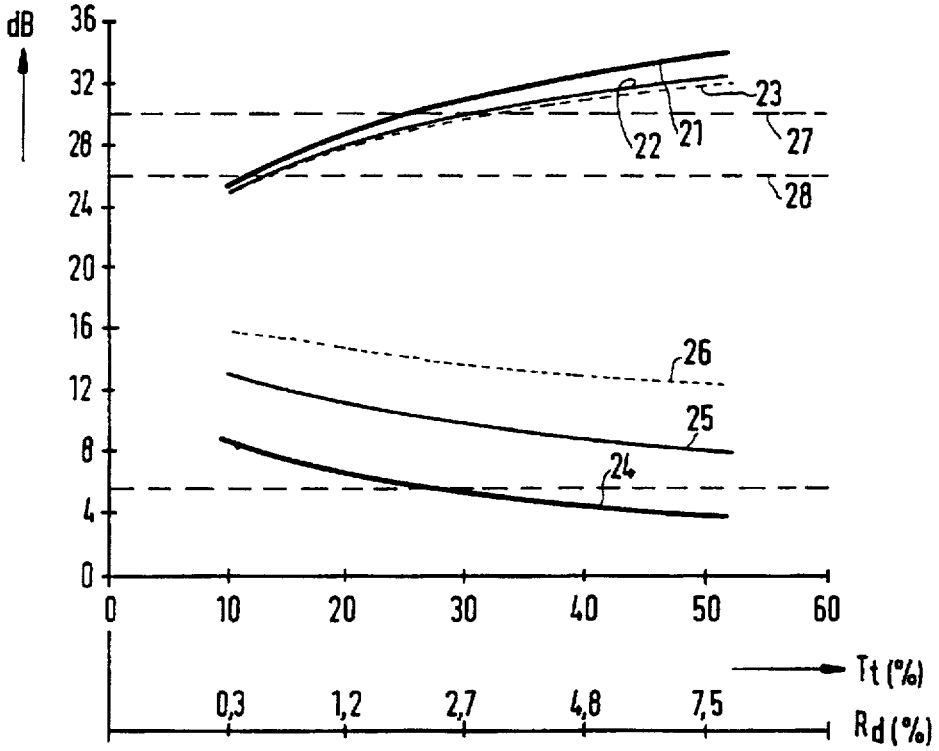
FIG. 2 is a graph illustrating brightness and contrast data for different glass transmissions at three different ambient light levels.

To illustrate the invention further, in FIG. 2 a brightness-contrast performance characteristic is presented for a 14"–15"–17"–21" CMT range of monitor products, as a function of the CMT's screen glass transmission, as well as of the ambient illuminance level.

The input parameters are, that the phosphor screen is of the black matrix type, the transmissivity $T_m$ being 14%, and that the screen load shall not exceed 1 μA/cm$^2$ and in particular not 0.85 μA/cm$^2$ .

CMT and CRT data sheets generally specify the so-called long term average anode current for the total of the three guns; from this, and the screen area, the current density can be derived, e.g.

| type | sh.mask material | long term av. an. current | scanned area | screen/mask current density |
|---|---|---|---|---|
| 14" M34ECL | iron | 450 μA | 591 $cm^2$(mus) | 0.76 μA/$cm^2$ |
| 15" M36EDR | invar | 500 μA | 606 $cm^2$(mus) | 0.83 μA/$cm^2$ |
| 21" M51EDF | invar | 1100 μA | 1239 $cm^2$(mus) | 0.89 μA/$cm^2$ |

This shows that an anode (=shadowmask, phosphor screen) current density of about 0.85 μA/$cm^2$ is applicable generally with the conventional CMT types.

FIG. 2 is a graph illustrating brightness and contrast data for different glass transmissions at three different ambient light levels $E_h$=4000, 1000 and 250 lux respectively. The horizontal axis denotes the total transmission $T_f$. The second horizontal axis denotes the diffuse reflection coefficient $R_d$. The vertical axis denotes the maximum brightness $B_{max}$+B (min+bs) (in cd/$^2$, left axis) expressed in dB in respect to a reference level of 0.1 cd/$m^2$ (right axis) and furthermore the contrast C (taking into account backscatter) in dB. Said graph basically shows some of the content of tables 1 to 3 below. Lines 21, 22 en 23 show $B_{max}$+B(min+bs) for $E_h$=4000, 1000 and 250 lux respectively. Lines 24, 25 and 26 show C for $E_h$32 4000, 1000 and 250 lux respectively. Lines 27 and 28 denote brightness levels of 100 cd/$m^2$ and 35 cd/$m^2$ respectively. Considering the graph presented in FIG. 2, the relative importance of the CMT's ability to preserve the black=black in high ambient illuminance conditions is striking (there are large difference between lines 24, 25 and 26) but also the relatively narrow band (=small difference) between the currently adapted luminance levels of 100 cd/$m^2$ as "normal" under high ambient illumination, and a level of "only" 35 cd/$m^2$ is remarkable. Line 29 gives denotes a contrast level of 4 (approximately 5.8 dB).

Thus FIG. 2 illustrates the brightness-contrast performance (in this example of a range of colour monitor tubes (CMT's) having screens with 14", 15", 17", 21" . . . screen diagonals). It shows that a black matrix tube ($T_{mat}$=M%) having an extremely dark screen ($T_f$=10%), when driven under normal conditions (beam current density<1 μA/$cm^2$, in particular<0.85 μA/$cm^2$, (EHT=25 kV)) can produce a brightness $B_{max}$=35 cd/$m^2$ with a sufficient contrast at an ambient illumination $E_h$=4000 lux. It further shows that e.g. a tube having a screen with $T_f$=25%, can produce a brightness $B_{max}$=100 cd/$m^2$, however the contrast at $E_h$=4000 lux in that case being somewhat less.

In tables 1, 2 and 3 below more detailed brightness and contrast data are presented relating to different choices of glass transmission $T_f$(glass+filter means) and ambient illuminance levels ($E_h$).

TABLE 1

(including backscatter deteriorations)

| | Glass transmissivity $T_f$ | | | | | | UNITS |
|---|---|---|---|---|---|---|---|
| ($E_h$ = 4000 lux) | 10 | 15 | 20 | 25 | 35 | 52 | % |
| $R_d$ | 0.3 | 0.7 | 1.2 | 1.9 | 3.7 | 8.2 | % |
| Bmin | 3.8 | 8.7 | 15.4 | 24 | 47.1 | 104 | cd/$m^2$ |
| Backscatter | .58 | .87 | 1.15 | 1.44 | 2.02 | 3.0 | cd/$m^2$ |
| B(min + bs) | 4.38 | 9.57 | 16.55 | 25.44 | 49.12 | 107 | cd/$m^2$ |
| | 16.42 | 19.81 | 22.19 | 24.06 | 26.91 | 30.29 | dB |
| Bmax | 29.8 | 44.6 | 59.6 | 74.4 | 104.1 | 154.7 | |
| Bmax + | 34.2 | 54.2 | 76.1 | 99.85 | 153.2 | 261.7 | cd/$m^2$ |

TABLE 1-continued (including backscatter deteriorations)

| | Glass transmissivity $T_f$ | | | | | | UNITS |
|---|---|---|---|---|---|---|---|
| ($E_h$ = 4000 lux) | 10 | 15 | 20 | 25 | 35 | 52 | % |
| B(min + bs) | 25.34 | 27.34 | 28.81 | 29.99 | 31.85 | 34.18 | dB |
| C(4000) | 7.8 | 5.66 | 4.60 | 4.09 | 3.12 | 2.45 | x |
| | 8.9 | 7.5 | 6.6 | 5.9 | 4.9 | 3.9 | dB |

TABLE 2

(including backscatter deteriorations)

| | Glass transmission | | | | | | UNITS |
|---|---|---|---|---|---|---|---|
| ($E_h$ = 1000 lux) | 10 | 15 | 20 | 25 | 35 | 52 | % |
| $R_d$ | 0.3 | 0.7 | 1.2 | 1.9 | 3.7 | 8.2 | % |
| Bmin | .96 | 2.2 | 3.8 | 6.0 | 11.8 | 26 | cd/$m^2$ |
| Backscatter | .58 | .87 | 1.15 | 1.44 | 2.02 | 3.0 | cd/$m^2$ |
| Bmin + bs | 1.54 | 3.07 | 4.95 | 7.44 | 13.8 | 29 | cd/$m^2$ |
| | 11.87 | 14.87 | 16.95 | 18.72 | 21.41 | 24.62 | dB |
| Bmax | 29.8 | 44.6 | 59.6 | 74.4 | 104.1 | 154.7 | |
| Bmax + | 31.3 | 47.7 | 64.5 | 81.8 | 117.9 | 183.7 | cd/$m^2$ |
| B(min + bs) | 24.95 | 26.78 | 28.09 | 29.13 | 30.72 | 32.64 | dB |
| C(1000) | 20.3 | 15.5 | 13.0 | 11.0 | 8.5 | 6.3 | x |
| | 13.1 | 11.9 | 11.1 | 10.4 | 9.3 | 8.0 | dB |

TABLE 3

(including backscatter deteriorations)

| | Glass transmission | | | | | | UNITS |
|---|---|---|---|---|---|---|---|
| ($E_h$ = 250 lux) | 10 | 15 | 20 | 25 | 35 | 52 | % |
| $R_d$ | 0.3 | 0.7 | 1.2 | 1.9 | 3.7 | 8.2 | % |
| Bmin | .24 | .54 | .96 | 1.50 | 2.94 | 6.50 | cd/$m^2$ |
| Backscatter | .58 | .87 | 1.15 | 1.44 | 2.02 | 3.0 | cd/$m^2$ |
| Bmin + bs | .82 | 1.31 | 2.11 | 2.94 | 4.96 | 9.50 | cd/$m^2$ |
| | 9.14 | 11.17 | 13.24 | 14.68 | 16.95 | 19.77 | dB |
| Bmax | 29.8 | 44.6 | 59.6 | 74.4 | 104.1 | 154.7 | |
| Bmax + B(min + bs) | | | | | | | |
| | 30.57 | 46.04 | 61.61 | 77.32 | 109.09 | 164.20 | cd/$m^2$ |
| | 24.85 | 26.63 | 27.90 | 28.88 | 30.38 | 32.15 | dB |
| C(250) | 37.3 | 35.2 | 29.2 | 26.3 | 22 | 17.3 | x |
| | 15.7 | 15.5 | 14.7 | 14.2 | 13.4 | 12.4 | dB |

NB. Due to the electron backscatter mechanism, the best contrast, even in zero ambient illuminance, is limited:

$B_{max}$=29.75 cd/$m^2$≡24.73 dB, with $T_f$=10%, and $B_{min}$=$B_{bs}$=0.58 cd/$m^2$≡7.63 dB to:

$C_o$=51.3 x≡17.1 dB, and not approaching infinity!

Because of this, seeking further contrast improvements in low ambient illuminance conditions by going to still lower transmission than 10% i.e. lower $R_d$ values than 0.3%, has almost no sense. Table 1 shows that for a display device for which in operation the beam current density on the screen is≦1 μA/$cm^2$, in particular≦0.85 μA/$cm^2$ a contrast in more than 4 is attainable for $R_d$<2.5% and a contrats between 4 and 8 is attainable for 0.3%≦$R_d$≦2.5%.

Furthermore is is remarked that preferably the diffuse reflection coefficient is more than 0.5%. Smaller values for $R_d$ means greater ratios between the diffuse reflection coefficients of surrounding surfaces which leads to a discomforting effect.

Figure 3:
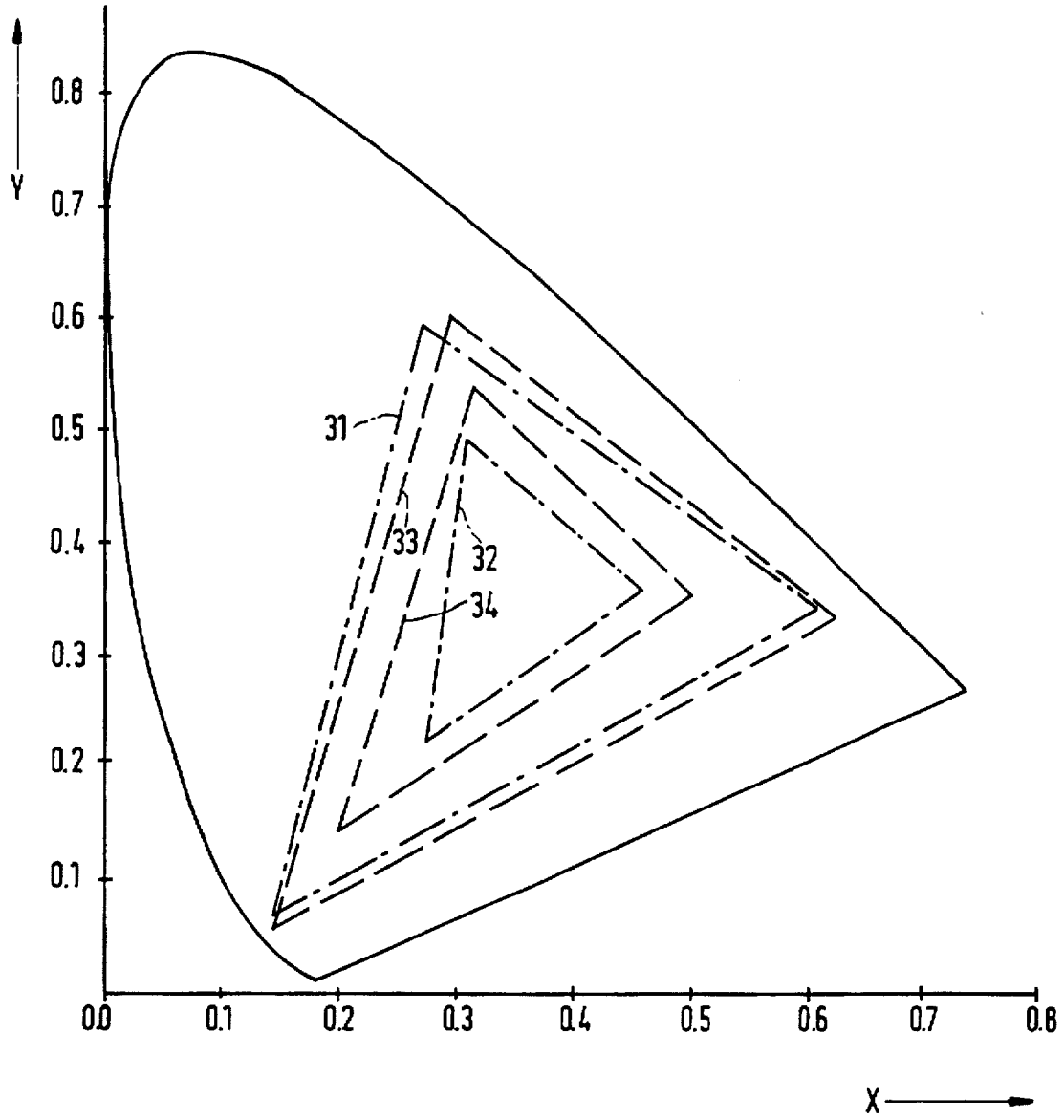
FIG. 3 is a graph illustrating the colour reproduction of a conventional CMT with $T_t$=52% and a high ambient CMT with $T_t$=25%, both at an ambient illuminance of 1000 lux.

A different aspect of the invention is that besides improving the contrast also an improved color reproduction is obtained. This is explained below. A high-ambient 15" CMT sample with $T_f \approx 25\%$ was prepared; the results in a CM4000 monitor, by visual comparison, were even more striking because of the perceived impact of the very much reduced desaturation of (primary) colours by the whitish, reflected ambient illuminance: see Table 4 and FIG. 3. In FIG. 3 the dot-dashed triangles 31 and 32 represent the colour gamut of a normal display screen with $T_f=52\%$ at "zero" illumination respectively in ambient illumination condition $E_h=1000$ lux and the dashed triangles 33 and 34 represent the colour gamut of a high ambient CMT display screen with $T_f=25\%$ at "zero" ambient illumination and in ambient illumination condition $E_h=1000$ lux. For both CMT's it holds that the size of the triangles is reduced under illumination (triangle 32 is smaller than triangle 31, triangle 34 is smaller than triangle 33). However triangle 34 is much larger than triangle 32. The smaller the triangle, the less color contrast (slight color differences) is percieved by a viewer and the less "natural" the colors are perceived. Especially so-called skin-tones are affected by a reduction of the triangles. Therefore a Hi-ambient cathode ray tube according to the invention gives besides a better contrast (as defined in intensity), also a better color reproduction.

Table 4 below shows more detailed information on the resluts of measurements.

The Hi-Ambient CMT's saturation improvements of especially blue (very visible!) almost dwarfs the gain to be had from e.g. the red, so-called EBU phosphors:

| | |
|---|---|
| blue: | δSDCM = 300 − 164 = 136 |
| red: | δSDCM = 72 − 58 = 14 by going to Hi-Ambient; |
| green: | δSDCM = 29 − 17.8 = 11.2 |
| red: | δSDCM = 15 − 0 = 15, by going to EBU (from "P22"). |

TABLE 4

| Test Results, in monitors | | "Normal" CMT | "Hi-Ambient" CMT (CIE 1931) |
|---|---|---|---|
| Colour coordinates, in ambient illumination condition $E_h$ = 1000 lux.(noon;overcast) (instrument:TOPCON Spectroradiometer,SR1) | | | |
| Red Field | x | .458 | .507 |
| | y | .354 | .350 |
| Green Field | x | .309 | .314 |
| | y | .493 | .531 |
| Blue Field | x | .251 | .202 |
| | y | .224 | .142 |
| Black Field | x | .347 | .346 |
| | y | .366 | .360 |
| | $T_c$ | 4993 | 5000 K |
| Colour coordinates, in "zero" ambient illumination condition (instrument: MINOLTA CA100) | | | |
| Red Field | x | .607 | .626 |
| | y | .339 | .337 |
| Green Field | x | .271 | .292 |
| | y | .594 | .599 |
| Blue Field | x | .146 | .143 |
| | y | .066 | .058 |
| Change of colour coordinate, due to $E_h$ = 1000 lux | | | |
| Red Field | δx | −.149 | −.119 |
| | δy | +.015 | +.013 |
| | SDCM | 72 | 58 |
| Green Field | δx | +.038 | +.022 |
| | δy | −.101 | −.068 |
| | SDCM | 29 | 17.8 |
| Blue Field | δx | +.105 | +.059 |
| | δy | +.158 | +.084 |
| | SDCM | 300 | 164 |

Comparitive tests indicate that the overall perceptual image quality as percieved by an "average" viewer, which overall perceptual image quality takes several factors into account such as a.o. contrast, brightness "naturalness" of the image, colourfullness, for high ambient illumination shows a peak, i.e. a highest rating, for high ambient illumination (i.e. higher than 1000 lux), below or approximately a value of $R_d$ of 2,5%.

Below several different embodiments of the invention will be discussed in more detail.

The total transmissivity coefficient of a faceplate $T_f$ is the product of the transmissivity of the faceplate and, if present, of transmission reducing coating(s) on the faceplate ($T_f = T_g \cdot T_{coat}$). Preferably the total faceplate transmissivity $T_f$ lies between 10–25%. By tuning the total faceplate transmission $T_f$, e.g. $10\% < T_f < 25\%$; the white field luminances $B_{max,4000}$ then range from 35 cd/m$^2$ —still conform the ISO 9241-3 min. luminance level—with $T_f \approx 10\%$, up to a more "normal" 100 cd/m$^2$ with $T_f \approx 25\%$. Prefered ranges are for a CMT with a black matrix $12.5\% \leqq T_f \leqq 29\%$, for a TVT with a black matrix $10\% \leqq T_f \leqq 25\%$ and for a CMT or TVT or a monochrome tube without a black matrix $5\% \leqq T_f \leqq 12\%$.

Within the concept of the invention the CRT display device is preferably provided with a transmission reducing coating. As explained above the total transmission is a product of the transmission of the faceplate and of the transmission of coating(s). The thickness of the faceplate is a.o. determined by safety considerations and shows a variation over the faceplate. As a consequence the transmission of the faceplate shows a variation over the faceplate. Such variation is the more prominent the lower the transmission coefficient of the faceplate. Typically the thickness of the faceplate varies 10–15% over the faceplate. This leads for instance for a faceplate transmission of 20% to a variation of the transmission of approximately 20–30%. The variation of $R_d$ is then approximately 40–60%. The thickness of the coating is, however, not dependent on safety considerations. By applying a transmission reducing coating the variation of $R_d$ over the faceplate of $R_d$ is therefore less. Preferably the transmission of the faceplate is higher than 40%. Within the framework of these embodiments of the invention means which perform the same function as transmission reducing coatings applied directly on the faceplate, such as coatings for instance neutral density filter and/or transmission reducing plates positioned in front of the faceplate, are to be understood to be equivalent to a "coating provided on the faceplate". Preferably, however, the coating is applied on a surface of the faceplate. Compared to the use of for instance a transmission reducing plate positioned in front of the faceplate, the number of elements is reduced. Such a coating preferably comprises a black dye.

Black dyes which are suitable for use in a transmission reducing coating are e.g. Orasol Black CN™ (Colour Index: Solvent Black 28) and Orasol Black RL™ (Colour Index, Solvent Black 29) available from Ciba Geigy; Zapon Black X51™ (Colour Index; Solvent Black 27) available from BASF and Lampronol Black™ (Colour Index: Solvent Black 35) available from ICI. Said dyes enable high-gloss black filtering layers to be manufactured. A very suitable dye is Orasol Black CN™ (Colour Index: Solvent Black 28) because it has a high resistance to light. According to the information provided by the supplier the chemical structural formula of the latter dye is a mono-azo chromium complex. Dependent upon the desired transmission, the dye is added to the alcoholic solution of the alkoxysilane compound in a predetermined concentration. In the wavelength range between 410 and 680 nm the transmission of the filtering layer comprising said dye is substantially constant and hence spectrally neutral. It has been found that these and other dyes can readily be leached when the filtering layer is in contact with customary cleaning liquids such as ethanol, acetone, diluted acetic acid, ammonium hydroxide, soap and salt water. By incorporating an oxide of Ge, Zr, Al or Ti or a mixture of one or more than one of said metal oxides in the silicon dioxide, a filtering layer is obtained which is better resistant to leaching of the dye. The above oxides can be incorporated in the filtering layer on the basis of the corresponding alkoxy compounds, such as tetraethyl orthogermanate $Ge(OC_2H_5)_4$(TEOG), tetrbutyl orthozirconate $Zr(OC_4H_9)_4$(TBOZ), tetrapropyl orthozirconate $Zr(OC_3H_7)_4$ (TPOZ), tripropyl orthoaluminate $Al(OC_3H_7)_3$ (TPOAl) and tetraethyl orthotitanate $Ti(OC_2H_5)_4$ (TEOTi).

The transmission reducing coating may be manufactured by providing, on the display screen, an alcoholic solution of an alkoxysilane compound, an alkoxy compound of at least one metal selected from the group formed by Ge, Zr, Al and Ti, acidified water and a black dye, followed by a treatment at an increased temperature, thereby forming the filtering layer comprising silicon dioxide, an oxide of the metal and the dye.

A suitable alkoxysilane compound is tetraethyl orthosilicate (TEOS). Other alkoxysilane compounds of the type $Si(OR)_4$, which are known per se, and oligomers thereof can alternatively be used, wherein R represents an alkyl group, preferably a $C_1$–$C_5$ alkyl group. Preferably, the alcoholic solution is applied to the display screen by spin coating. After drying and heating to, for example, 160° C. for 30 minutes a black, smooth and high-gloss filtering layer is obtained in this manner. A very black screen, e.g. with $T_t$<30% may be produced by multiple coating of the screen with a filtering layer. If desired, the alcoholic solution can be applied by spraying, thereby forming a mat filtering layer having anti-glare properties. For the alcohol, use can be made of ethanol, propanol, butanol, diacetone alcohol or a mixture thereof. By means of acidified water the alkoxy groups are converted into hydroxy groups which react with each other and with hydroxy groups of the glass surface of the display screen. During drying and heating, polycondensation brings about a suitably adhering oxidic network of silicon dioxide in which oxides of one or more than one of the metals Ge, Zr, Al and Ti and the dye are incorporated. For the alkoxy compounds of the said metals use is made of compounds of the formula: $M(OR)_n$, where M=Ge, Zr, Al or Ti; R=$C_1$–$C_5$ alkyl group and n is the valency of the metal M. The above-mentioned compounds TEOG, TBOZ, TPOZ, TPOAl and TEOTi can be used by way of example. Preferably Orasol Black CN™ (Colour index: Solvent Black 28) is used as the black dye because it has the above-mentioned favourable properties.

Preferably the applied transmission reducing coating shows an increase of the transmission from the centers to the sides. The decrease of the transmission due to the thickness increase of the faceplate from the center of the faceplate to the sides is thereby at least partly counteracted.

Preferably the CRT display device is provided with means to reduce the specular reflection of the faceplate, preferably on the inner as well as on the outer side of the faceplate. Preferably the specular reflection on the outer side is less than 0.5%. An advantageous embodiment comprises a multilayer coating on the outside which functions as a transmission reducing coating as well as as a specular reflection reducing coating.

I claim:

1. A CRT display device including an envelope having a faceplate, a luminescent screen disposed within the envelope and a means for generating an electron beam for exiting the screen to effect production of a luminescent image, characterized in that the diffuse reflection coefficient of the faceplate is less than 2.5% ($R_d \leqq 0.025$), where $R_d = T_t^2 * T_{coat}^2 * F$, where $T_t$ is the total transmissivity of the faceplate, $T_{coat}$ is the transmissivity of coatings on the faceplate, and F is a factor determined by the diffuse reflectance of the luminescent screen.

2. A CRT display device as claimed in claim 1, characterized in that the diffuse reflection coefficient is more than 0.3%.

3. A CRT display device as claimed in claim 2, characterized in that the diffuse reflection coefficient is more than 0.5%.

4. A CRT display device as claimed in claim 1, characterized in that the total faceplate transmission $T_t$, e.g. 10%<$T_t$<25%, preferably ≦20%.

5. A CRT display device as claimed in claims 1, characterized in that the CRT display device comprises a transmission reducing coating.

6. A CRT display device as claimed in claim 5, characterized in that the transmission of the faceplate is higher than 40%.

7. A CRT display device as claimed in claim 6, characterized in that the transmission reducing coating is applied on the faceplate.

8. A CRT display device as claimed in claim 7, characterized in that the transmission reducing coating shows an increase of the transmission from the center to the sides of the faceplate.

9. A CRT display device as claimed in claim 1, characterized in that the CRT display device is provided with means to reduce the specular reflection of the faceplate.

10. A CRT display device as claimed in claim 9, characterized in that the specular reflection of the outer side of the faceplate is less than 0.5%.

11. A CRT display device as claimed in claim 9, charcaterized in that the specular reflection of both the inner and outer side of the faceplate is reduced.

12. A CRT as claimed in claim 7, characterized in that the CRT display device comprises a multilayer coating on the outside of the faceplate which functions as a transmission reducing coating as well as a specular reflection reducing coating.

13. A display device as claimed in claim 1, characterized in that the luminescent screen has a screen diagonal selected from the sizes 14", 15", 17" and 21".

14. A display device as claimed in claim 1, characterized in that in operation the beam current density on the screen is ≦1 μA/cm², in particular ≦0.85 μA/cm².

15. A display device as claimed in claim 1, characterized in that for a beam current density on the screen of ≦1 μA/cm², in particular ≦0.85 μA/cm².a $C_{4000}$ contrast of $4 \leqq C_{4000} \leqq 8$ is obtainable.

16. A CRT display device as claimed in claim 2, characterized in that the total faceplate transmission $T_t$, e.g. 10%<$T_t$,25%, preferably ≦20%.

17. A CRT display device as claimed in claim 3, characterized in that the total faceplate transmission $T_t$, e.g. 10%<$T_t$<25%, preferably ≦20%.

18. A CRT display device as claimed in claim 2, characterized in that the CRT display device comprises a transmission reducing coating.

19. A CRT display device as claimed in claim 3, characterized in that the CRT display device comprises a transmission reducing coating.

20. A CRT display device as claimed in claim 4, characterized in that the CRT display device comprises a transmission reducing coating.

21. A CRT as claimed in claim 9, characterized in that the CRT display device comprises a multilayer coating on the outside of the faceplate which functions as a transmission reducing coating as well as a specular reflection reducing coating.

* * * * *